US005275485A

United States Patent [19]

Lücke

[11] Patent Number: 5,275,485

[45] Date of Patent: Jan. 4, 1994

[54] DEVICE FOR MOVING SOLID PARTICLES

[75] Inventor: Roland Lücke, Paderborn, Fed. Rep. of Germany

[73] Assignee: Gebruder Lodige Maschinenbau GmbH, Bundesrepublik Deutschland, Fed. Rep. of Germany

[21] Appl. No.: 859,384

[22] PCT Filed: Oct. 21, 1990

[86] PCT No.: PCT/DE90/00800

§ 371 Date: May 19, 1992

§ 102(e) Date: May 19, 1992

[87] PCT Pub. No.: WO91/06364

PCT Pub. Date: May 16, 1991

[30] Foreign Application Priority Data

Oct. 24, 1989 [DE] Fed. Rep. of Germany ..... 3935290

[51] Int. Cl.[5] ..... B01F 15/06

[52] U.S. Cl. ..... 366/149; 366/15; 366/91

[58] Field of Search ..... 366/149, 144, 147, 14, 366/15, 24, 91; 99/348.

[56] References Cited

U.S. PATENT DOCUMENTS

| | | | |
|---|---|---|---|
| 1,462,602 | 7/1923 | Labus et al. . | |
| 3,196,941 | 7/1965 | Matsuoka . | |
| 3,480,404 | 11/1969 | Upson . | |
| 3,776,529 | 12/1973 | Sutter et al. . | |
| 3,964,874 | 6/1976 | Maruko | 366/149 |
| 4,159,740 | 7/1979 | Seiling . | |

FOREIGN PATENT DOCUMENTS

| | | | |
|---|---|---|---|
| 328710 | 3/1973 | Austria | B29J 5/02 |
| 1112968 | 8/1958 | Fed. Rep. of Germany . | |
| 2053476 | 10/1970 | Fed. Rep. of Germany . | |
| 2802876 | 1/1978 | Fed. Rep. of Germany | B01F 7/04 |
| 3100309 | 1/1981 | Fed. Rep. of Germany | B01F 7/08 |
| 953603 | 9/1947 | France . | |
| 2202719 | 9/1973 | France | B01F 7/02 |
| 60-125243 | 12/1983 | Japan | B01F 15/06 |
| 631633 | 9/1947 | United Kingdom . | |

*Primary Examiner*—Robert W. Jenkins
*Attorney, Agent, or Firm*—Walter A. Hackler

[57] ABSTRACT

A device for moving solid particles, especially one designed as cooling mixer, has a substantially horizontal jacketed tank (11), in which a shaft (14) is seated for rotation. The shaft (14) is equipped with mixing tools. Bulk material can be introduced into the tank (11) through a charging opening (23), and the processed material can be extracted from the tank (11) through a discharge opening (26). The product space of the tank (11) is equipped with partition walls which subdivide the product space into processing zones. The solid-particle mixer (10) is particularly well suited for quasi-continuous operation. Processing of the bulk material is carried out in the pile and product feeding toward the discharge opening (26) is effected in the state of a mechanically generated fluidized bed, or a product toroid.

8 Claims, 9 Drawing Sheets

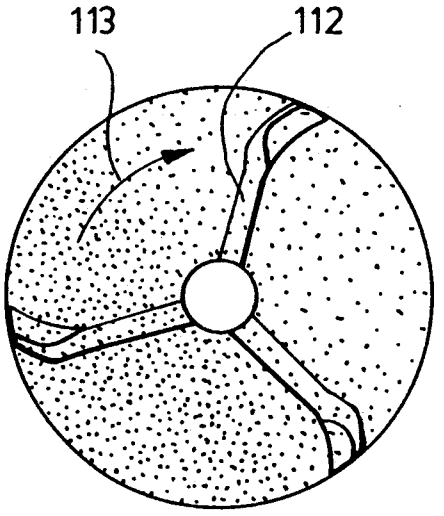
Fig. 5a
Fig. 5b
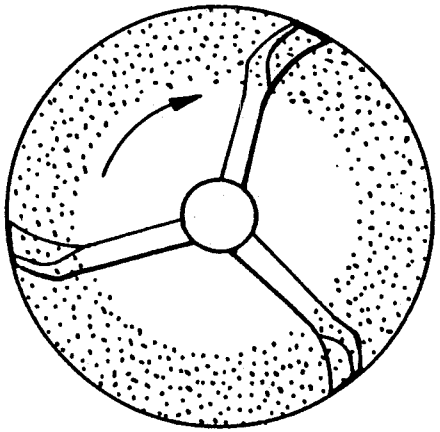
Fig. 5c

DEVICE FOR MOVING SOLID PARTICLES

BACKGROUND OF THE INVENTION

The present invention relates to a device for moving solid particles, especially one designed as cooling mixer, having a substantially horizontal jacketed tank, which is passed along its longitudinal axis by a shaft connected to a drive motor and carrying radially extending tools, which when rotating act to mix solid particles contained in the bulk material by setting them into forced movement, and having further charging and discharge openings arranged on the tank and at least two partition walls, provided each with at least one passage opening and arranged in the tank between the charging and the discharge openings, transversely to the longitudinal axis.

A device of this kind has been known from DE-AS 11 12 968.

Devices for mixing solid particles using rotating tools, comprising a horizontal cylindrical tank and a shaft with mixing tools arranged coaxially in the tank, have been known before in the form of batch-type and continuous-type mixers.

In batch-type operation, the machine, which is used as mixer, drier, reactor, or cooler, is at first charged with the bulk material or materials and/or additives to be processed. The charging process, once completed, is followed by a processing operation by which the bulk materials are mixed, cooled, dried, heated, disintegrated or agglomerated. This process may be accompanied also by reactions which may give rise to new products, or may release gases which are then evacuated through suitable vapor pipes. Upon completion of the treating process, the products are discharged from the machine by a separate discharging operation.

For the purpose of determining the time required for preparing solid-particle mixtures by means of batch-type mixers, it is necessary to sum up the charging time required for the bulk materials to be mixed, the discharging time for the finished mixture, and the mixing time as such is required by the batch-type mixer to mix the bulk materials with themselves and with each other by means of the rotating mixing tools. This results in longer mixing times for the batch-type mixer, as compared with continuous-type mixers. In continuous operation, the waiting times required for charging and discharging the mixer do not occur. In continuous operation, the bulk materials to be processed are supplied to the mixer continuously, and at the same time the finished mixture is discharged continuously. This is possible also in the case of bulk materials which are to be subjected to thermal treatment or to be cooled in continuous operation. If a cooling process is to be carried out in continuous operation, the hot solid-particle material is introduced into the cooling mixer, while at the same time the cooled bulk material is extracted from the other end of the cooling mixer.

In continuous operation, however, certain difficulties are encountered with respect to controlling the transport behavior of the bulk materials to be cooled in such a way as to prevent, for example, cooled bulk material to get mixed up with bulk material of higher temperature or even hot bulk material. If reverse mixing occurs, then the mixing temperature of the bulk material in the product space will always be higher than the desired end temperature. And in addition, reverse mixing causes cooled particle populations to stay in the product space longer than the permissible time. Such particle populations may be destroyed by the mixing tools, being subjected to prolonged mechanical treatment. This makes it necessary, when cooling a flow of bulk materials in continuous operation, to keep the rate of reverse mixing between treated and untreated materials as low as possible. However, it is often not possible with the known devices to control the cooling process in this way since rigidly predetermined process parameters often prevent corresponding operating modes and since, on the other hand, the time required for reducing the temperature in bulk materials by heat transfer to a cooling agent cannot be reduced at desire.

Known mixers normally operate at a rigidly preset rotational speed, specific to the particular device and adapted to the particular process. In order to maintain the cinematic similarity, the dimensionless value Fr (Froude number) is introduced, instead of the rotating speed n. Fr is a dimension independent of the drum diameter, describing the ratio of centrifugal acceleration to gravitational acceleration. The Froude number can be described by the following formula:

$$Fr = \frac{m \times \omega^2 \times r}{m \times g},$$

wherein m is the mass of particles, r is the radius of the drum, g is the gravitational acceleration, defined by the formula $g = r \cdot n_c^2 \cdot 4\pi^2$, $\omega$ is the angular velocity of the mixing tool, and $n_c$ is the critical speed.

In the case of the continuous-type solid particle mixer known from the doctoral thesis of 1984 entitled "Untersuchungen zur Schüttgutbewegung beim kontinuierlichen Feststoffmischen" (Studies on the movement of bulk material during continuous mixing of solid matter) (Process Engineering Faculty of the Stuttgart University), the mean dwelling time of the bulk material in the solid particle mixer can be controlled via the bulk mass stored in the product space and via the bulk mass flow. The product space of this solid-particle mixer extends from the delimiting surface at the mixer end to a weir provided in the cylindrical drum, directly in front of the product discharge pipe. The bulk mass stored between the weir and the product charging pipe is subjected to heavy reverse mixing at rotational speeds of $Fr \geqq 4$, as illustrated for example by the diagrams on page 108 of this paper, where the axial dispersion coefficient D is plotted as a function of the Froude number Fr. However, as has been stated before, this is a disadvantage when a bulk material flow is to be cooled continuously.

As can be seen in FIG. 2 of the drawing, the mixer known from DE-AS 11 112 968 comprises a jacket, which is not explained in detail in the specification. However, if effective thermal treatment is to be ensured, it is not sufficient merely to provide a tank jacket; the latter then necessarily has to be designed in such a way as to permit effective cooling or heating of the product flowing through the tank. In addition, an uncontrolled flow of product is permitted through the openings at the bottom of the partition walls.

SUMMARY OF THE INVENTION

Now, it is the object of the present invention to improve a solid particle mixer of the type described at the outset in such a way as to enable the thermal treatment of the flow of bulk material to be controlled efficiently over the entire length of the solid-particle mixer.

This object is achieved according to the invention by the fact that the tank comprises a jacket for thermal treating of the solid particles which encloses the tank over more than 180°, but less than 360° in the circumferential direction, and that the jacket comprises an axial charge line on one side and an axial discharge line on another side, and that the circumferential section not provided with the jacket is arranged in an upper area of the tank.

The solid-particle mixer according to the invention thus provides the substantial advantage that it can be thermally cooled or heated in the cross-flow mode. The known heating or cooling mixers of the horizontal type can be operated only in the parallel-flow or counter-flow modes, because the known constructional design of the jacket only permits a fluid flow in the longitudinal direction of the product flow. If a central supply and discharge line extends in the longitudinal direction of a solid-particle mixer according to the invention, with connections to the jacket, then the fluid cooling or heating the product can be guided around the circumference of the jacket in transverse direction to the product flow. From the thermal point of view, this provides the advantage that a maximum temperature difference can be achieved, with a constant fluid inlet temperature, at the product inlet and at the product outlet.

The solid-particle mixer according to the invention further provides the advantage that it subdivides the products space, i.e. the space extending in the axial direction between the end face of the charging end, and the partition wall before a product discharge pipe, into at least two processing zones where the product flow can be processed almost independently of the other processing zone.

In the case of the process known as pile mixing, no solid particles are separated from the main bed. The bulk material remains entirely in the respective processing zone, provided the passage openings are located above the product level. For example, if in the case of a solid-particle mixer according to the invention a bulk material is to be cooled continuously, no solid particles can pass from the one processing zone into the other, if pile cooling is employed, and consequently no reverse mixing within the processing zone can occur, either. Axial dispersion can take place only within the respective processing zone.

Depending on the particular requirements, the product space can be subdivided into several processing zones separated from each other by partition walls. Now, when the rotating speed is increased to such a degree that a fluidized bed is mechanically produced by the tools in the product space, then particle swarms can pass through the passage openings and enter the respective neighboring processing zone. In this way, the processing zone located directly beneath the charging opening can be emptied and subsequently filled with a new batch. New product can be introduced into the processing zone located beneath the charging opening already while the bulk material of the preceding batch is still being processed in the neighboring processing zone.

The particular configuration of the product space enables the solid-particle mixer according to the invention to be operated advantageously also in a quasi-continuous mode. In this connection quasi-continuous mode means an operating mode where the bulk material or materials flow into the product space by batches, but leave it as a continuous product flow. Conversely, this term also describes the case where the solid-particle mixer according to the invention is charged continuously, while the processed bulk material is discharged from the solid-particle mixer by batches.

If the solid-particle mixer according to the invention is operated as a batch-type mixer or a batch-type cooler in the range of $Fr > 1$, then it is always guaranteed that a particle exchange along the shaft, i.e. transverse mixing, can occur only within the processing zones defined by the partition walls. This also enables products of different processing steps to be separated effectively in batch-type operation.

The operation of the solid-particle mixer according to the invention is not merely a multiple-chamber operating mode for batch-type or continuous-type or quasi-continuous-type mixers in a horizontal drum, but rather an operating mode which largely separates the functions of processing the bulk material and transporting it in the axial direction toward the discharge end. Processing is effected in the pile, transporting in the mechanically generated fluidized state, or in a toroid state. Linking these two operating modes in one and the same machine, therefore, is one of the essential ideas of the invention.

The rotating tools transport the bulk material away from the charging opening and toward the discharge opening. The rotational speeds, which produce the mechanically fluidized bed or the product toroid of the bulk material in the product space, increase the feeding component directed toward the discharge end. Consequently, the bulk material can be rapidly discharged from the processing zones, and transported toward the discharge end. If the product flow is to be cooled, then this can be effected by effective mixing in the pile in the respective processing zone, and the transport in axial direction and into the neighboring processing zone, in the direction of the discharge end, is then effected by fluidizing the bulk material, i.e. by short-time generation of a mechanically fluidized bed or a product toroid in the product space.

The jacketed tank according to the invention makes it possible to operate the solid-particle mixer as a cooling mixer, or to employ it as a solid-particle mixer or, making use of an agent of higher temperature, to employ it as a solid-particle mixer for the heat-treatment of bulk materials. In this case, cooled and/or heated water, steam or thermal oil may flow through the tank jacket, and cryogenic fluids may also be used.

If, according to a preferred embodiment of the invention, the tank is provided with heat input and/or heat dissipation elements on or in the tank wall, running around the circumference of the tank over more than 180°, but less than 360°, then it is always ensured that the whole bulk mass stored in the entire product space is always kept in contact with interior wall sections of the tank which are actively cooled or heated.

According to another embodiment of the invention, the circumferential section not provided with such elements is arranged in the upper area of the tank.

This provides the advantage that the elements are arranged in those tank areas where high heat transfer coefficients are reached. As can be derived from the publication entitled "Local heat transfer coefficients in a plowshare mixer", Verfahrenstechnik 76, No. 12, the heat transfer coefficients measured in the lower tank area differed from the heat transfer coefficients in the upper tank area by the factor four.

According to a further improvement of the invention, the jacket or the elements are subdivided, in the longitudinal direction of the tank, into sections permitting heat to be introduced or dissipated independently in each section.

This provides the advantage that the bulk material in the product space can be heated or cooled to a greater or lesser degree in different sections in the longitudinal direction of the tank. A solid-particle mixer designed in this way provides greater versatility and can be adapted more effectively to a given set of procedural steps.

If the jacket consists of semi-circular pipes welded to the outside of the tank and provided with a central supply line and drain line, then the direction of flow of liquid carrier agents is predetermined. The flow resistances in the jacket are defined. If the semi-circular pipes consist of individual semi-circular pipes welded to the tank jacket in a substantially semi-circular pattern, then this increases the stiffness of the tank, and the tank can be given a reduced wall thickness.

If an opening lid extending almost over the full length of the tank is provided in the upper area of the tank, then the solid-particle mixer according to the invention can be cleaned easily and rapidly, if desired. Moreover, any exchange of tools or any work on the cutter-head systems is facilitated in this case. The opening lid as such is not covered with semi-circular pipes. This permits the opening lid to be produced easily and at low cost. In addition, this fact reduces the weight of the opening lid so that it can be operated easily by hand.

According to another embodiment of the invention, the partition walls are arranged to be cooled or heated.

This provides the advantage that additional cooling and/or heating surfaces are provided in the product space. The bulk material is pressed into contact with the cooled and/or heated surfaces of the partition walls, due to its own movement, and also by the rotating tools. Consequently, a particularly effective heat transfer is obtained at these points. If the shaft and the tools are cooled or heated in addition, this will support and improve the cooling or heating process even further.

According to a preferred embodiment of the invention, the drive motor is a change-pole motor, or a motor with infinitely variable speed.

This provides the advantage that processing of the bulk material can be carried out in the pile in the respective processing zones. The rotating tools introduce into the bulk material only little energy so that the material is heated up only insignificantly in a cooling process. In addition, mixing of the bulk material to be processed is performed very gently. If the bulk material is to be transported from one processing zone into the next, the speed of the centrifuging unit is increased for a short time. In the fluidized state, the bulk material can then overcome the partition walls, passing through the passage openings. The tools are designed and inclined relative to the shaft in such a way as to support the transport of the bulk material, in the fluidized state, in the direction toward the discharge end.

Another embodiment of the invention proposes a method of operating a device for moving solid particles in multiple-chamber operation, the particular advantage of which is seen in the fact that the device is of the quasi-continuous type. The product space stores a bulk mass big enough to ensure that stepwise introduction of bulk material into the product space does not affect the continuous discharge flow of the bulk material. The processing zones are separated one from the other by partition walls so that the first processing zone, being arranged immediately beneath the charging opening of the solid-particle mixer according to the invention, can be charged by batches, while the processed material is discharged continuously from the last processing zone of the product space, via the product discharge pipe.

If the product is treated in the pile, and the product is transported toward the discharge end in the state of a mechanically generated fluidized bed, or a product toroid, then reverse mixing of the bulk material within the product space, and its transport to the product discharge pipe can be optimally controlled.

The solid-particle mixer according to the invention, therefore, meets the full range of demands placed especially on devices intended for cooling bulk materials. It may be operated by batches, continuously, or quasi-continuously. Several tank sections arranged along the solid-particle mixer can be operated independently of each other, with agents of different temperatures. Due to the particular operating mode of the solid-particle mixer, i.e. cooling in the pile, transporting the bulk material in the fluidized state, it is possible to achieve high heat-removal rates. The cooling process is supported by a cooled shaft, cooled tools and cooled partition walls. The passage openings are arranged in the product space in such a way that short-circuit flows of the bulk material are prevented and axial dispersion is largely confined to the respective processing zone.

Other advantages can be derived from the following description and the attached drawing. The features that have been described above, and those which will be described hereafter, can be employed either individually or in any combination. The described embodiments are mentioned by way of example only and are not to be understood as a comprehensive list of possible embodiments.

The invention will now be described by way of certain embodiments, with reference to the drawing in which.

Figure 1:
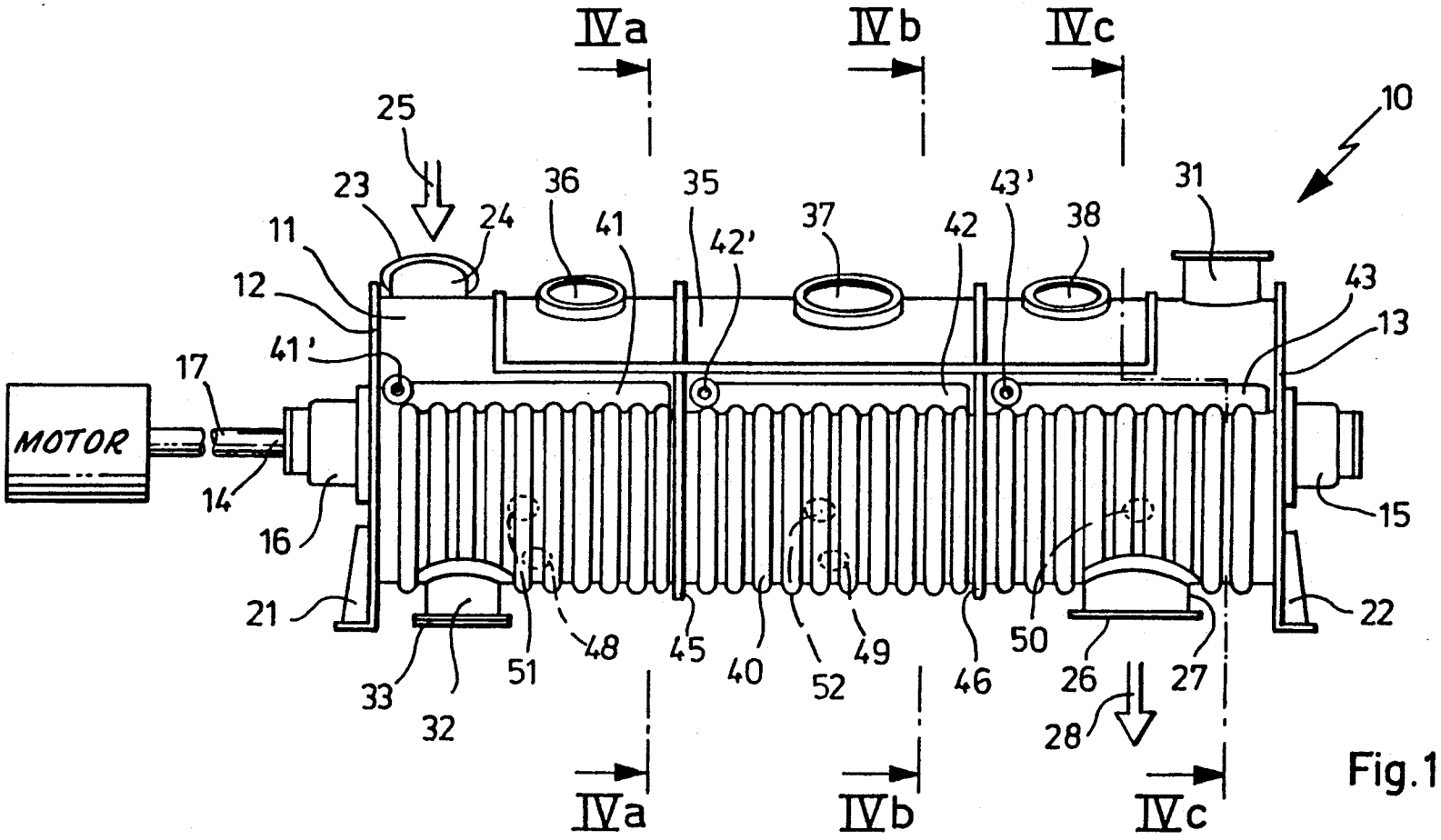
FIG. 1 shows a solid-particle mixer according to the invention, equipped with semi-circular pipe coils forming a double jacket, and an opening lid extending almost over the full length of the solid-particle mixer.
Figure 4A:
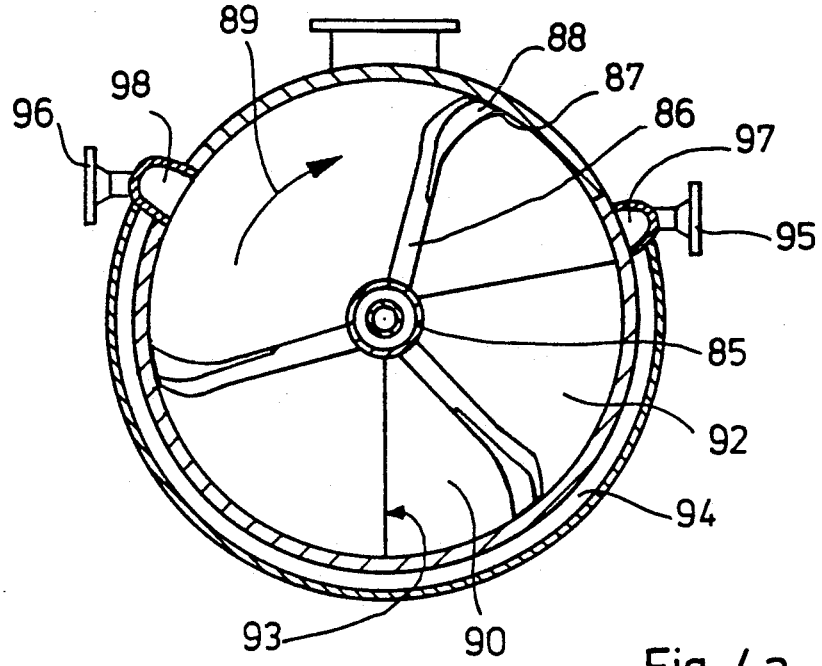
Figure 4B:
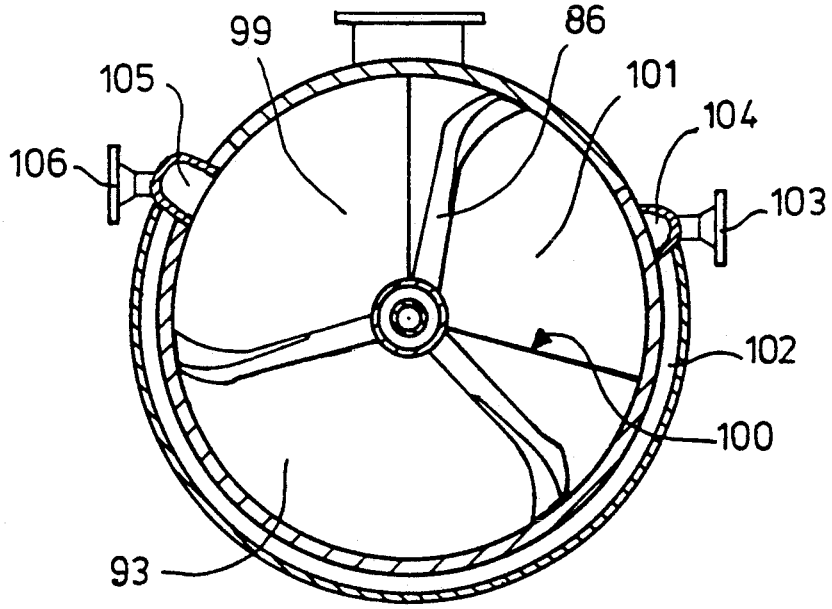
Figure 4C:
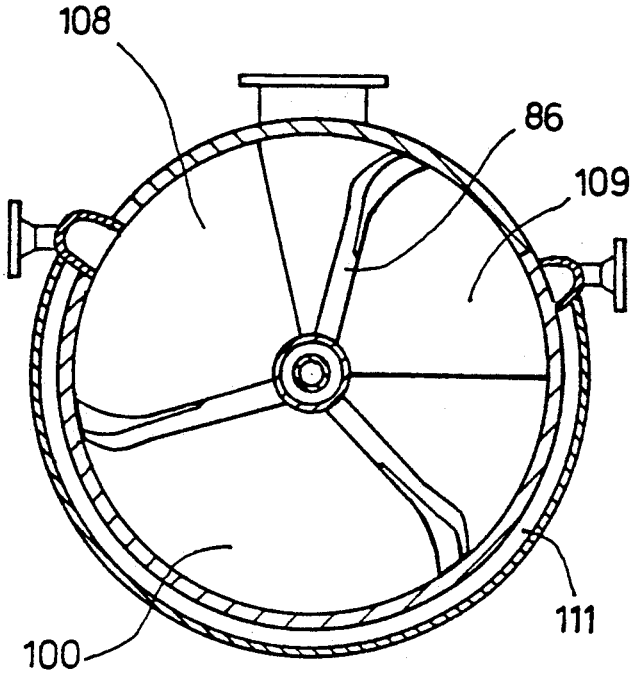
Figure 6A:
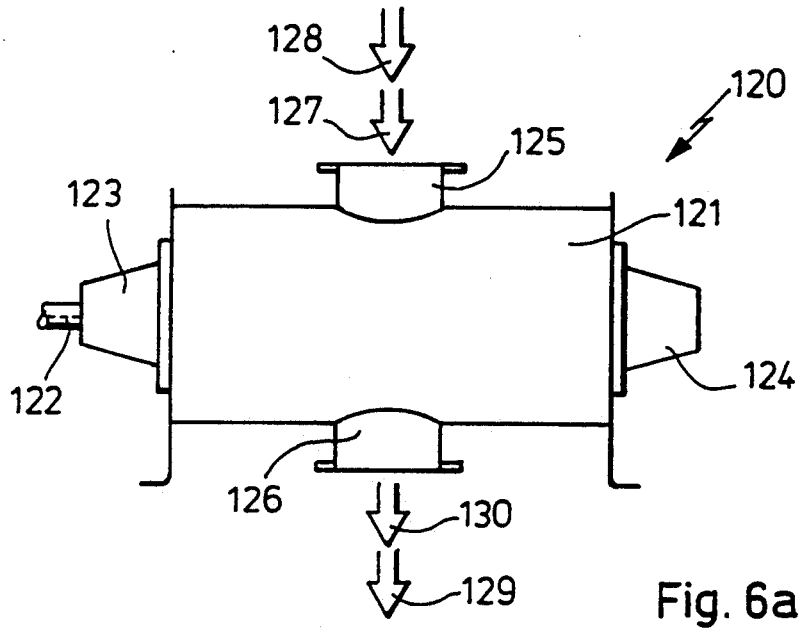
Figure 6B:
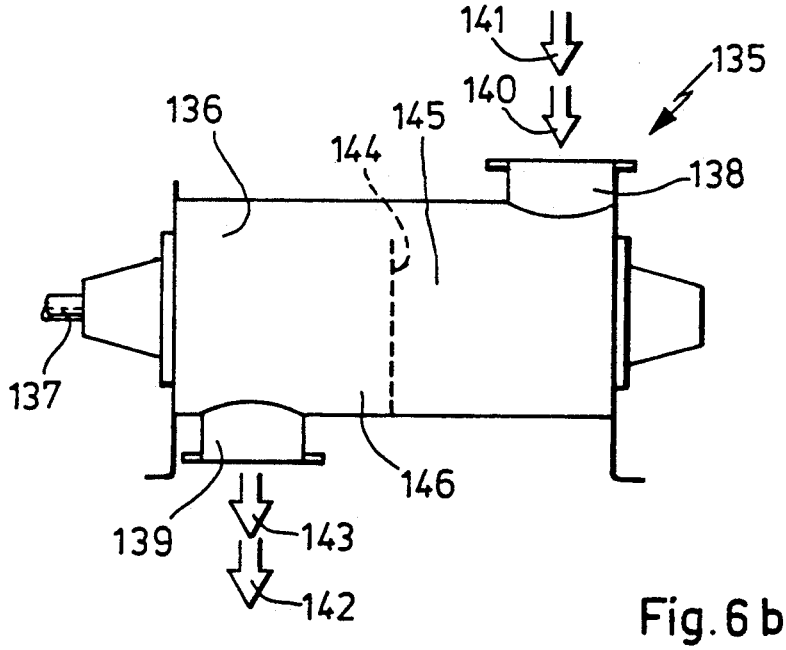
Figure 7:
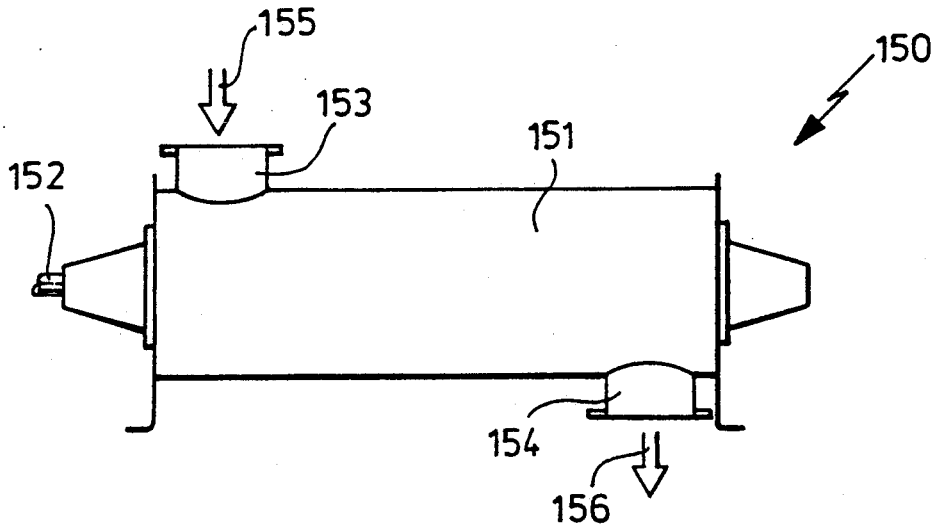
Figure 8A:
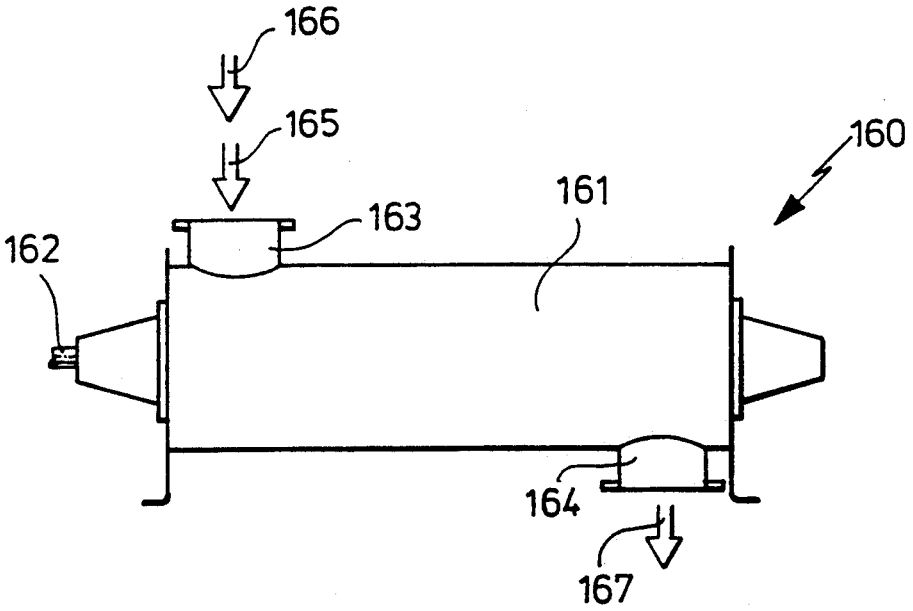
Figure 8B:
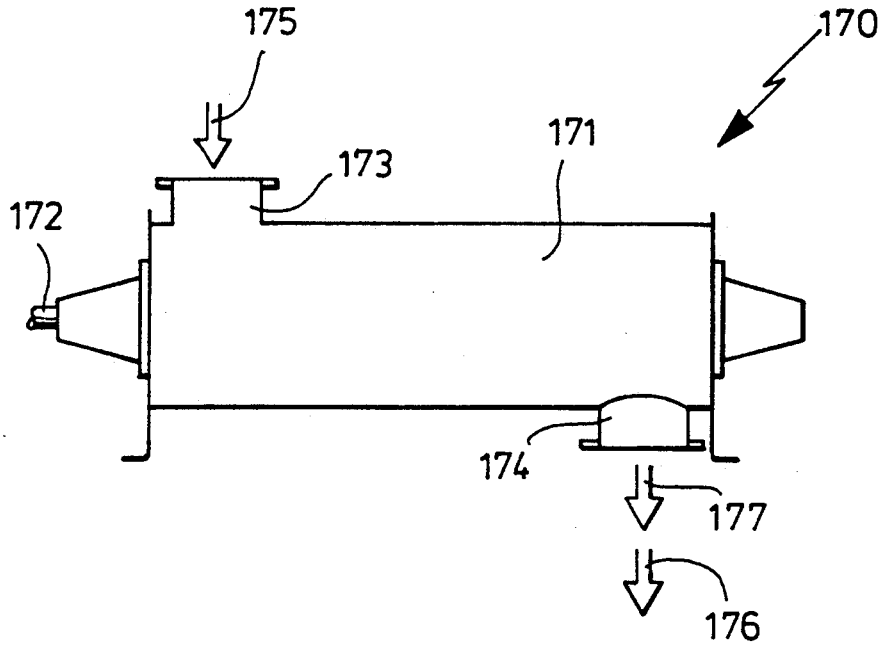

FIG. 4*a* shows a section along line IVa—IVa in FIG. 1;

FIG. 4*b* shows a section along line IVb—IVb in FIG. 1;

FIG. 4*c* shows a section along line IVc—IVc in FIG. 1;

FIGS. 5*a*, 5*b*, 5*c* show a diagrammatic representation illustrating the product movement in the product space of the solid-particle mixer according to the invention, at different rotational speeds;

FIG. 6*a* shows a batch-type mixer with product charging and discharge pipes arranged in the conventional manner;

FIG. 6*b* shows a batch-type mixer where the pipes are arranged in such a way as to permit the creation of different processing zones;

FIG. 7 shows a solid-particle mixer of the conventional continuous type;

FIG. 8*a* shows a solid-particle mixer of the quasi-continuous type according to the invention; and FIG. 8*b* shows another embodiment of a quasi-continuous solid-particle mixer.

The different figures of the drawing depict the object of the present invention, in part very diagrammatically, and are not true to scale. The details of the different figures are in part greatly enlarged in order to permit their structure to be seen more clearly.

FIG. 1 depicts a solid-particle mixer 10 capable of mixing and cooling and/or thermally treating bulk materials in batch-type operation, or else in continuous or quasi-continuous operation. The solid-particle mixer 10 comprises a tank 11, a horizontal cylindrical drum and end pieces 12, 13 provided at the end of the tank 11. The end pieces 12, 13 may be welded or screwed to the ends of the tank 11. The end pieces 12, 13 are provided with a circular through-opening arranged coaxially relative to the longitudinal axis of the tank 11. A shaft 14 extends through the through-opening in the end pieces 12, 13 and is rotatably seated in bearings 15, 16 connected with the end pieces 12, 13. The free end of the shaft 14, i.e a shaft end 17, projects beyond the bearing 16 and can be connected to a motor via a suitable gearing. The unit comprising the motor and the gearing serves as drive unit for the shaft 14. Inside the tank, the shaft 14 carries mixing elements which can be set into rotation together with the shaft.

The solid-particle mixer 10 can be mounted on foundations and/or frame structures via supports 21, 22 Inclined to the rear in FIG. 1, one can see a charging opening 23 of the tank 10, which is designed in the form of a charging pipe 24 provided with a flange. The bulk material to be processed can be introduced into the tank 11 through the charging pipe 24, in the direction of arrow 25. The flange provided on the charging pipe 24 enables the charging opening 23 to be connected to pipe and charging systems. In the lower area of the tank 11, one can see a discharge opening 26 configured as a discharge pipe 27 provided with a suitable flange. The bulk material processed in the solid-particle mixer 11 can be discharged through the discharge pipe 27 in the direction of arrow 28.

Another opening in the tank 11 is constituted by a vent pipe 31 which enables the pressure in the tank to be compensated, or vapors or gases to be extracted. Another pipe 32 arranged in the tank bottom, opposite of the charging pipe 24, is closed by a blind flange 33. This pipe 32 enables bulk material in the tank to be discharged, or the flow of bulk material entering the tank in the direction of arrow 25 to be controlled in such a way that the bulk material will leave the tank 11 through the pipe 32 immediately after having entered the tank 11. This may be desirable, for example, in cases where the solid-particle mixer 10 is part of a greater plant system, and the processing operation rendered possible by the solid-particle mixer 10 is not needed in a particular case, or if trouble is encountered with the solid-particle mixer 10. Between the discharge pipe 27 and the pipe 32, still other pipes may be arranged on the solid-particle mixer 10, for enabling the individual processing zones to be evacuated directly.

In the configuration of FIG. 1, an opening lid 35 is arranged along the upper face of the solid-particle mixer 10. The opening lid 35 may be hand-operated and/or may be opened and closed automatically, by suitable means. Integrated in the opening lid 35 are sight-glasses 36, 37, 38 which enable the flow of bulk material in the tank 11 to be visually inspected.

Welded to the outer tank wall are semi-circular pipe coils 40, which are connected to charging lines 41, 42, 43 in such a way that the charging lines 41, 42, 43 are capable of centrally supplying the semi-circular pipe coils 40 with a cooling/heating agent. The connection to a suitable cooling/heating supply unit is effected by a flange connection 41', 42', 43'. The charging lines 41, 42, 43 are separated one from the other so that each semi-circular pipe connected to a charging line 41, 42, 43 can be operated separately with agents of different temperatures. The flange connections 41', 42', 43' can be connected to each other so that all semi-circular pipes 40 are supplied parallel or serial with the same cooling-/heating agent, for example, by using external tubes or by connection to a suitable cooling/heating device. At the rear of the solid-particle mixer 10, which cannot be seen in the drawing, the semi-circular pipe coils 40 terminate by opening into an outlet line of a design similar to that of the charging lines 41, 42, 43. The semi-circular pipe coils 40 extend around the tank 11 in circumferential direction, over more than 180°, but less than 360°.

The term semi-circular pipe coils is also meant to describe half-pipes which are arranged on the tank jacket in circular arc form and which do not guide the flowing agent along a continuous spiral path.

At the rear of the solid-particle mixer 10, the semi-circular pipes 40 extend further up than on the front. This constructional feature of the semi-circular pipe coils 40 on the tank 11 allows even a product that has been lifted in the sense of rotation to be in full contact with cooled surfaces of the tank 11.

The outer wall of the tank 11 is equipped with supporting rings 45, 46 which also extend over the opening lid 35. The supporting rings 45, 46 stiffen the tank 11 so that a constant circular drum shape with very narrow tolerances is obtained over the full length of the tank 11. Semi-circular pipe coils 40 arranged in circular arc form further improve the inherent rigidity of the tank 11.

Temperature sensors 48, 49, 50 are provided at the rear of the solid-particle mixer 10 and are passed through the tank wall and into the product space. With the aid of these temperature sensors 48, 49, 50, it is possible to determine the product temperature in the respective tank section. If required, the solid-particle mixer 10 can be additionally equipped with quickly rotating cutter head systems 51, 52, which may, in addition to the mixing effect achieved by the tools on the shaft 14, disintegrate any agglomerations that may have formed, or may influence the grain size distribution of the product being processed.

Figure 2:
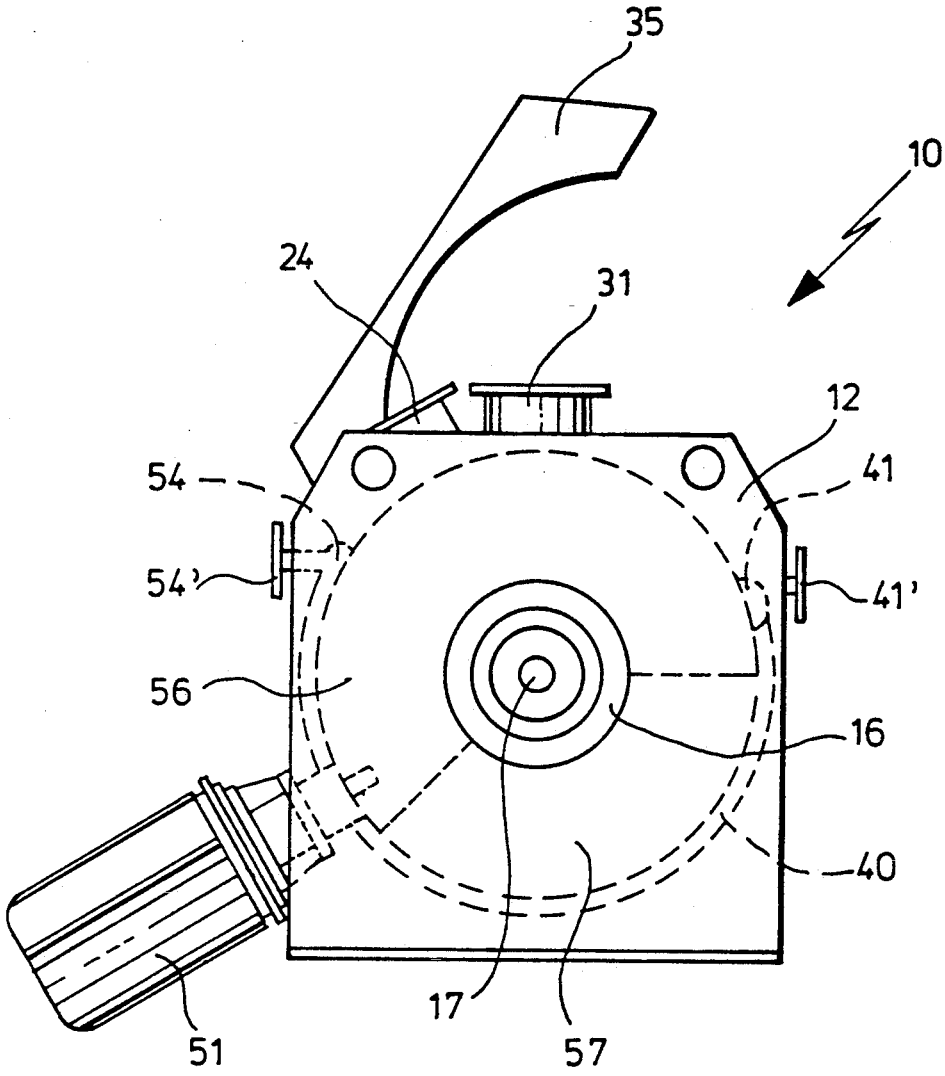
FIG. 2 shows a side view of a solid-particle mixer according to the invention, with the opening lid in open position and a cutter head system in place.

FIG. 2 shows a side view of the solid-particle mixer 10. The end piece 12 conceals the horizontal drum, which is indicated in the figure by broken lines. The shaft end 17 projects from the bearing 16 in which the shaft is rotatably supported. The opening 35 is in its open position, and the charging pipe 24 is visible, as is the venting pipe 31. The semi-circular pipe coils 40 and the charging line 41, as well as an outlet line 54, are indicated on the outer tank wall. The pipes 41', 54', serve to connect the semi-circular pipe coils 40 to an energy supply unit and an outlet system, respectively, which are not shown in the drawing. The charging and outlet lines 41, 54 may also both be arranged on one longitudinal side of the solid-particle mixer 10. In this case, the fluid flowing through the charging and the outlet lines 41, 54, crosses the product flow twice, flowing at first around the tank 11 in transverse direction to the longitudinal axis, and then back once more in transverse direction to the longitudinal axis of the tank 11. In the lower tank area, the cutter head system 51, which is provided with a drive of its own, is arranged laterally to extend through tank wall in an oblique upward direction.

FIG. 2 also shows a partition wall 56 with a passage opening 47. Bulk product entering the tank space through the charging pipe 24 can be transported along the shaft only through the passage opening 57. The fluid used for cooling or heating the product is supplied to the solid-particle mixer 10 over its full length through the pipe ends 41' and the charging line 41, and after having passed the semi-circular pipe coils 40 in a direction transverse to the product flow, it is then drained through the outlet line 54 and the pipe 54'.

Figure 3:
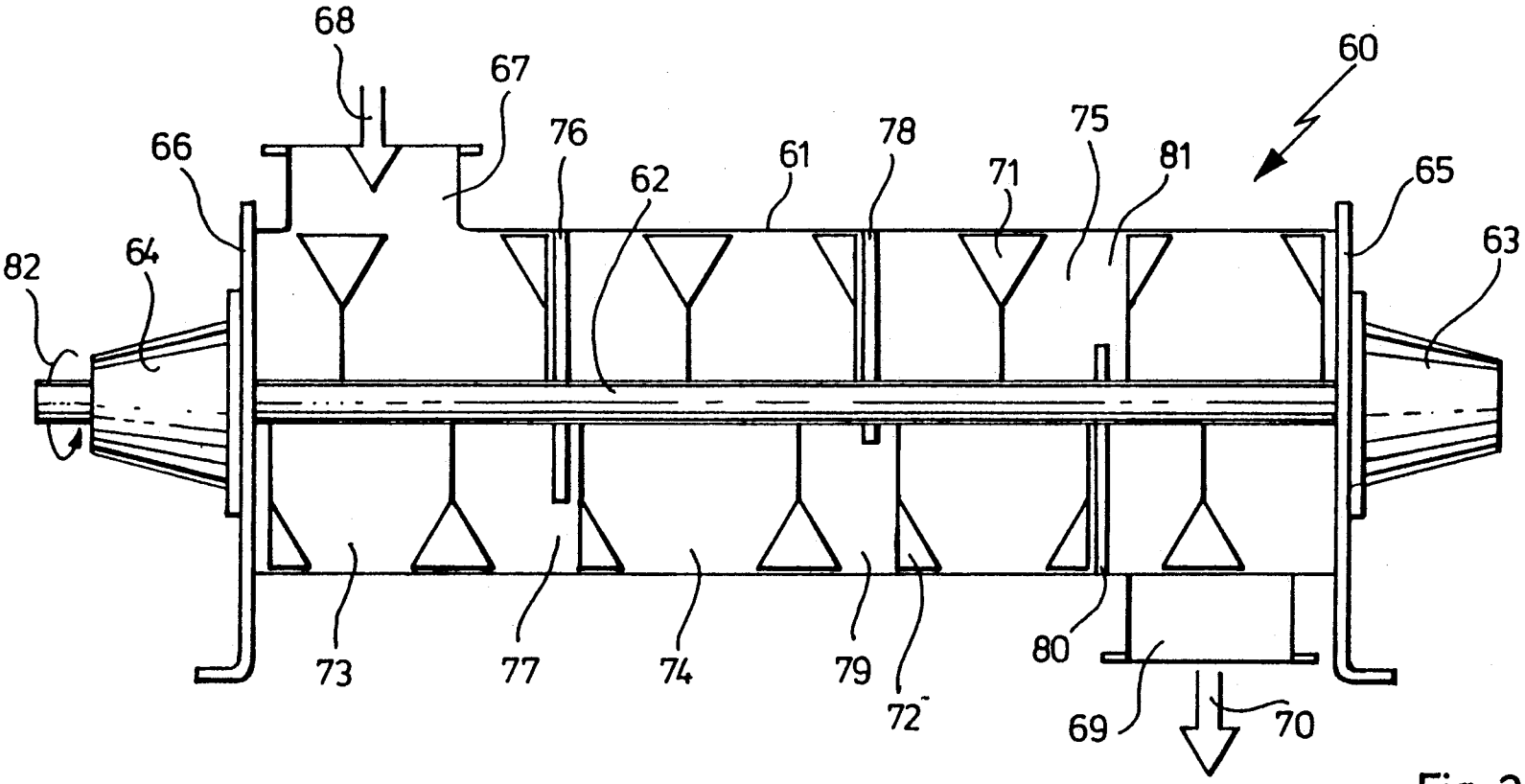
FIG. 3 shows one embodiment of a product space of a solid-particle mixer according to the invention, with mixer elements indicated diagrammatically.

FIG. 3 shows a very diagrammatic longitudinal section through a solid-particle mixer 60. A cylindrical, horizontal drum 61 houses a shaft 62 which is rotatably seated in bearings 63, 64 fixed on end pieces 65, 66. Bulk product can enter the product space through a charging pipe 67, in the direction indicated by arrow 68. The processed product can leave the product space via a discharge pipe 69, in the direction indicated by arrow 70. All tools, which are fixed on the shaft to rotate with it, are indicated in the figure diagrammatically as full blades 71 and half-blades 72. The product space is subdivided in this figure into a first processing zone 73, a second processing zone 74 and a third processing zone 75. The first processing zone 73 is axially defined by the end piece 66 and a partition wall 76. The partition wall 76 is provided with a passage opening 77 through which the bulk material, which enters the space in the direction of arrow 68, can be fed from the first processing zone 73 into the second processing zone 74. Feeding of the product in the product space is effected on the one hand by the product flow as such, and on the other hand by a motion component produced by the rotating full blades 71 and half-blades 72 and acting in the axial direction, toward the discharge pipe 69. The second processing zone 74 is delimited, toward the charging pipe 67, by the partition wall 76 and, toward the discharge pipe 69, by a partition wall 78. The partition wall 78 is provided with a passage opening 79, connecting the second processing zone 74 with the third processing zone 75. The third processing zone 75 is delimited by the partition wall 78 and a partition wall 80. A passage opening 81 in the partition wall 80 interconnects the third processing zone 75 and the space where the discharge pipe 69 is arranged. In case of need, the space equipped with the discharge pipe 69 may be converted into an additional processing zone, by suitable operation of closure members provided on the discharge pipe 69. When the shaft 62, which together with the full blades 71 and the half-blades 72 forms the centrifuging unit, is rotated in the direction of arrow 82, the solid particles of the bulk material are intimately mixed by the full blades 71 and the half-blades 72, and simultaneously transported from the first processing zone 73 into the second processing zone 74, and also into the third processing zone 75, due to the inclination of the full blades 71 and the half-blades 72 relative to the shaft 62. The partition walls 76, 78, 80 further have the effect to prevent any short-circuit when the solid-particle mixer 60 is operated in the continuous or quasi-continuous mode. The term short-circuit as used in this connection means that solid particles entering the product space through the charging pipe 67 leave the product space immediately thereafter through the discharge pipe 69, without having dwelled in the first, second, third processing zones 73, 74, 75 for the respective mean dwelling time. The partition walls 76, 78, 80 may have passage openings 77, 79, 81 of different sizes. The size and position of the passage openings 77, 79, 81 depends on the particular product and must be adapted to the characteristics of the particular product, such as bulk density, stock density, grain size range, yield function. As regards their position, the passage openings 77, 79, 81 may be arranged in the upper or in the lower drum area. In most of the cases, the passage openings 77, 79, 81 are staggered in such a way as to prevent the product from flowing directly from the charging pipe 67 to the discharge pipe 69.

FIG. 4*a* shows a section along line IVa—IVa through the tank 11 of FIG. 1. The opening lid has been omitted in this figure. Tools 86 are mounted on a hollow shaft for rotation with the latter. The tools 86 are designed as plowshare-type mixing tools. They are provided with a leading pointed end 87 and lateral cheeks 88 extending therefrom and serving as working surfaces, with at least one of the cheeks 88 being inclined relative to the sense of rotation 89 of the mixing tool in such as way as to form an obtuse angle with a perpendicular to the longitudinal axis plane which includes the longitudinal axis of the mixing tools. The obtuse angle, at which the cheeks 88 of the mixing tool are inclined, corresponds approximately to the internal lines of rupture of the product formed when a plane surface is passed through the product. The tools 86, as well as the hollow shaft 85, are passed by a cooling or heating agent. A first processing zone 90 is delimited on its discharge end by a partition wall 91. The partition wall 91 is provided with a passage opening 92 interconnecting the first processing zone 90 with a second processing zone 93 located behind the partition wall 91. A cooling and/or heating agent flows through semi-circular pipe coils 94. The cooling and/or heating agent enters the jacket through a pipe 95 and leaves the jacket system through a pipe 96.

A charging line 97 distributes the cooling and/or heating agent uniformly over the individual semi-circular pipes 94. After having passed the individual semi-circular pipe coils 94, the cooling or heating agent is collected in an outlet pipe 98 and drained centrally via the pipe 96.

FIG. 4*b* shows the section along line IVb—IVb in FIG. 1. A partition wall 99 separates the second processing zone 93 from a third processing zone 100 The rotating tools 86 transport the product from the second processing zone 93 through a passage opening 101 into the third processing zone 100. Semi-circular pipes 102, which are fed via a pipe 103 and a charging line 104, can be operated with a cooling or heating agent of a temperature different from that which is circulated through the semi-circular pipes 94 illustrated in FIG. 4*a*. The cooling or heating agent leaves the jacket through a central outlet line 105 and a pipe 106 The opening lid has been omitted in the sectional representation of FIG. 4*b*.

FIG. 4*c* shows a section along line IVc—IVc in FIG. 1. A partition wall 108 defines the third processing zone 100 toward the discharge end. The process product flows through a passage opening 109 in the partition wall 108 to the space provided with the outlet pipe. The tools 86 rotating in the third processing zone 100 transport the product toward the partition wall 180 and lift it through the passage opening 109. Again, semi-circular pipe coils 111 forming the jacket of the drum section of the third processing zone 100, can be operated with a cooling or heating agent of a temperature different from the temperatures used in the first processing zone 90 and/or the second processing zone 93.

The partition walls 91, 99, 108 can be cooled or heated as well. The product, which is transported from the product inlet to the product outlet, builds up in front of the respective partition walls 91, 99, 108. They develop a force opposite to the axial feeding sense of the product.

FIGS. 5*a*, 5*b* and 5*c* are very diagrammatic representations of the product movement in the device according to the invention. The motion behavior of the product in the product space varies in response to the Froude number, which is a measure of the ratio of centrifugal velocity to gravitational velocity. Initially, when the centrifuging unit rotates slowly, the product is lifted in the sense of rotation. This condition is shown in FIG. 5*a*. Tools 112 rotate in the sense indicated by arrow 113 and move the individual solid particles in the pile. As a result of this action, the free product surface assumes an angle corresponding approximately to the angle of repose of the material being processed. While mixing in the pile, only little energy is introduced into the product by the tools. The solid particles are mixed intensively in the direction toward the heated or cooled wall.

Regarding now FIG. 5*b*, an increasing amount of solid particles is thrown from the pile into the free mixing space as the tools 112 start rotating at a higher Froude number in the direction of arrow 113. The pile gets more and more fluidized. This process is called solid particle mixing in the mechanically produced fluidized state. The higher rotational speed gives rise to the development of more frictional energy, and the product is heated as a result of its intensive movement. If cooling is to be effected by the device according to the invention, the rising product temperature developing as a result of the quickly rotating tools 112 can be counteracted directly by the use of cooled tools and cooled partition walls.

In FIG. 5*c*, the centrifuging unit is running at a rotational speed which produces a more or less closed product toroid in the product space. The consistency of the product toroid corresponds to that of a compacting pile. The frictional forces are high, and the product to be treated is strongly heated up.

In the case of the device according to the invention, the states of movement of the product illustrated in FIG. 5*b* and FIG. 5*c* are produced for a short time only, and only at intervals. Increased rotational speeds serve to transport the cooled product through the passage openings and into the next following processing zone. The increased axial feed of the product is achieved within a few seconds, and during the longer time interval following thereafter the cooling mixer can be operated at a rotational speed which leads to the condition illustrated in FIG. 5*a*.

The device is equipped with a change-pole and/or an infinitely variable drive in order to enable the product states illustrated in FIGS. 5*b* and 5*c* to be produced at certain intervals. Cooling as such is effected by moving the product in the pile, i.e., that the rotating product will be operated with a Froude number of $Fr<1$.

FIG. 6*a* depicts a solid-particle mixer 120 of the batch-type design. A cylindrical drum 121, preferably provided in horizontal arrangement, accommodates a shaft 121 carrying mixing tools and being rotatably supported in bearings 123, 124. The drum 121 is provided with a charging pipe 126 and a discharge pipe 126. Arrows 127, 128 stand for product batches. These are introduced into the product space of the drum 121 one by one. Once all of the product batches have entered the product space of the solid-particle mixer 120, treating of the solid particle pile can commence. The solid particles are mixed in transverse and also in radial direction over the entire product space, it being not possible with the batch-type mixer illustrated in FIG. 6*a* to separate individual product volumes in the product space, and to subject them to different treatments after a predetermined operating time, the bulk product will be carried out through discharge pipe 126 in the direction of arrows 129, 130.

FIG. 6*b* shows another embodiment of a solid-particle mixer 135 of the batch-type design. A drum 136 accommodates and seats a shaft 137 carrying mixing elements. The drum 136 is provided with a charging pipe 238 on its one end face and with an discharge pipe 139 on its other end face. The product to be processed is introduced by batches into the solid particle mixer 135, in the direction indicated by arrows 140, 141, through the charging pipe 138, as is discharged, at the end of a predetermined processing time, through the discharge pipe 139 in the direction indicated by arrows 142, 143. The charging pipe 138 is mounted on the drum 136 in such a way as to obtain the greatest possible distance from the discharge pipe 139. Inside the drum 136, processing zones, separated by partition walls, may be created. In FIG. 6*b*, a partition wall which subdivides the product space into a first processing zone 145 and a second processing zone 146 is indicated by a broken line 144. The product to be processed can be introduced into the first processing zone 145 by batches, and treated product can be discharged from the second processing zone by batches, independently in time, in the direction of arrows 142, 143. As long as the product is treated in the pile in the product space, the product masses of the individual processing zone 145, 146 are separated one from the other. Indepently of the discharge of product through the discharge pipe 139, product may flow into the product space of the first processing zone 145 via the charging pipe 138. The transport of the product in the product space, from the first processing zone 145 to the second processing zone 146, is effected in the fluidized state, i.e. in the mechanically produced fluidized bed and/or in the state of a product toroid. This state is achieved by causing the mixing tools to rotate at a higher Froude number, and by arranging the mixing tools on the shaft 137 in such a way that they develop a feeding effect toward the product discharge end.

As is generally known, the pipes of batch-type mixers may be arranged at desire. Discharging of the product is a function of the inclination of the mixing tools relative to the shaft. Batch-type mixers usually have a length-/diameter ratio of 1:2.

FIG. 7 shows a solid-particle mixer 150 which is operated as a continuous-type mixer. A drum 151 accommodates a shaft 152. The shaft 152 carries the mixing elements. Product is introduced into the product space of the solid-particle mixer 150 through a charging pipe 143, and discharged after treatment via a discharge pipe 154. The bulk products enter the solid-particle mixer 150 in the direction indicated by arrow 155, which stands for the continuous product flow. Partition walls may be provided to subdivide the product space of the solid-particle mixer 150 into different processing zones, separated one from the other. In each processing zone, the bulk material is mixed both radially and axially.

FIG. 8*a* shows an example of a solid-particle mixer 160 of the quasi-continuous type, whose drum 161 accommodates a shaft 162 and is provided with a charging pipe 163 and a discharge pipe 164. Bulk material is introduced by batches into the product space of the drum 161, in the direction indicated by arrows 165, 166, and is discharged continuously after treatment in the direction of arrow 167. This quasi-continuous operation is obtained according to FIG. 8*a* by the fact that the product is introduced by batches and is discharged continuously.

FIG. 8*b* shows another example of a solid-particle mixer 170 of the quasi-continuous type. The bulk material, which enters the mixer through a charging pipe 173 is processed in a drum 171 by means of rotating mixing tools arranged on a shaft 172. After treatment, the product is discharged through a discharge pipe 174. After treatment, the product is discharged through a discharge pipe 174. In FIG. 8*b*, the solid-particle mixer 170 is charged continuously in the direction of arrow 175, and is discharged by batches in the direction of arrows 176, 177. The product space of the solid-particle mixer 170 may be subdivided into different processing zones. By operating the centrifuging unit in a suitable way, the product flow in the product space of the mixer 170 can be controlled so that any product present in the first processing zone, which is located near the charging pipe 173, is transferred into the second processing zone as quickly as possible. The further processing zones are likewise filled with product. Given the fact that the first processing zone is discharged more rapidly than the following processing zones, it is in a position to accept the continuous product flow in the direction of arrow 175 without any difficulty, and piling up of the product and overfilling of the first processing zone can be prevented.

The length/diameter ratio of solid-particle mixers of the continuous and the quasi-continuous type usually is greater than two, and the position of the charging pipe relative to the discharge pipe is selected in such a way as to obtain the greatest possible distance between these two elements.

I claim:

1. Device for moving solid particles comprising:

a substantially horizontal tank having a shaft mounted for rotation along a longitudinal axis of the tank, said tank further including charge and discharge openings;

at least two partition wall means for dividing the tank into at least three communicating chambers, each partition wall means having at least one passage opening, said partition wall means being arranged in the tank between the charge opening and the discharge opening, transversely to the tank longitudinal axis, at least one partition wall means having said passage opening disposed in an upper part thereof;

tool means for providing a tangential and/or axial impulse to solid particles in said tank; and jacket means for thermal treating of the solid particles, said jacket means enclosing said tank over more than 180°, but less than 360° in a circumferential direction, said jacket means including an axial charging line on one side thereof and an axial discharge line on another side thereof, said jacket means extending almost the entire length of the tank.

2. The device according to claim 1 wherein said jacket means is subdivided, in the longitudinal direction of the tank, into sections enabling heat to be introduced of dissipated independently in each section.

3. The device according to claim 2, wherein said jacket means comprises semi-circular pipes welded to an outside of the tank.

4. The device according to claim 3 wherein said shaft and said tool means form a heatable or coolable centrifuging unit.

5. The device according to claim 4 further comprising a motor, having infinitely variable speed, attached to said shaft.

6. The device according to claim 1, wherein said jacket means comprises semi-circular pipes welded to an outside of the tank.

7. The device according to claim 1 wherein said shaft and said tool means form a heatable or coolable centrifuging unit.

8. The device according to claim 1 further comprising a motor, having infinitely variable speed, attached to said shaft.

* * * * *